United States Patent [19]

Szostak

[11] 4,259,915

[45] Apr. 7, 1981

[54] TREADLE DRIVE FOR ELECTRIFIED SEWING MACHINE

[75] Inventor: Jan Szostak, Lincroft, N.J.

[73] Assignee: The Singer Company, Stamford, Conn.

[21] Appl. No.: 176,829

[22] Filed: Aug. 11, 1980

[51] Int. Cl.[3] ..... D05B 69/00

[52] U.S. Cl. ..... 112/217.4; 112/220

[58] Field of Search ..... 112/217.4, 217.3, 220, 112/221

[56] References Cited

U.S. PATENT DOCUMENTS

| | | | |
|---|---|---|---|
| 1,792,816 | 2/1931 | Chason | 112/217.4 |
| 3,408,882 | 11/1968 | Bialy | 112/217.4 X |
| 3,543,707 | 12/1970 | Schweers | 112/217.4 |
| 3,545,391 | 12/1970 | Schweers | 112/220 |

FOREIGN PATENT DOCUMENTS

| | | | |
|---|---|---|---|
| 609156 | 9/1960 | Italy | 112/217.4 |

*Primary Examiner*—H. Hampton Hunter

*Attorney, Agent, or Firm*—Edward P. Schmidt; Robert E. Smith; Edward L. Bell

[57] ABSTRACT

A reverse treadling inhibiting device having an electric motor connected to a sewing machine arm shaft through a one-way clutch and inhibiting the reverse treadling of the sewing machine by utilizing the one-way clutch connection to the electric motor to add inertia and resistance to reverse treadling of the sewing machine.

3 Claims, 5 Drawing Figures

Fig. 4
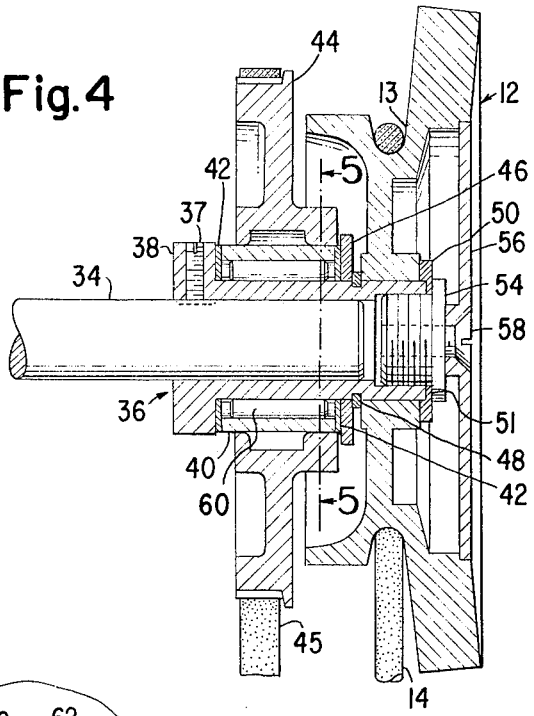
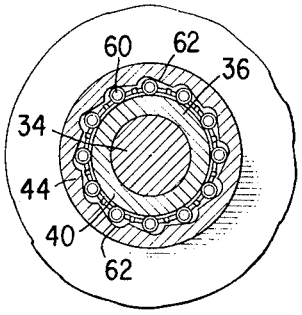
Fig. 5
Fig. 3
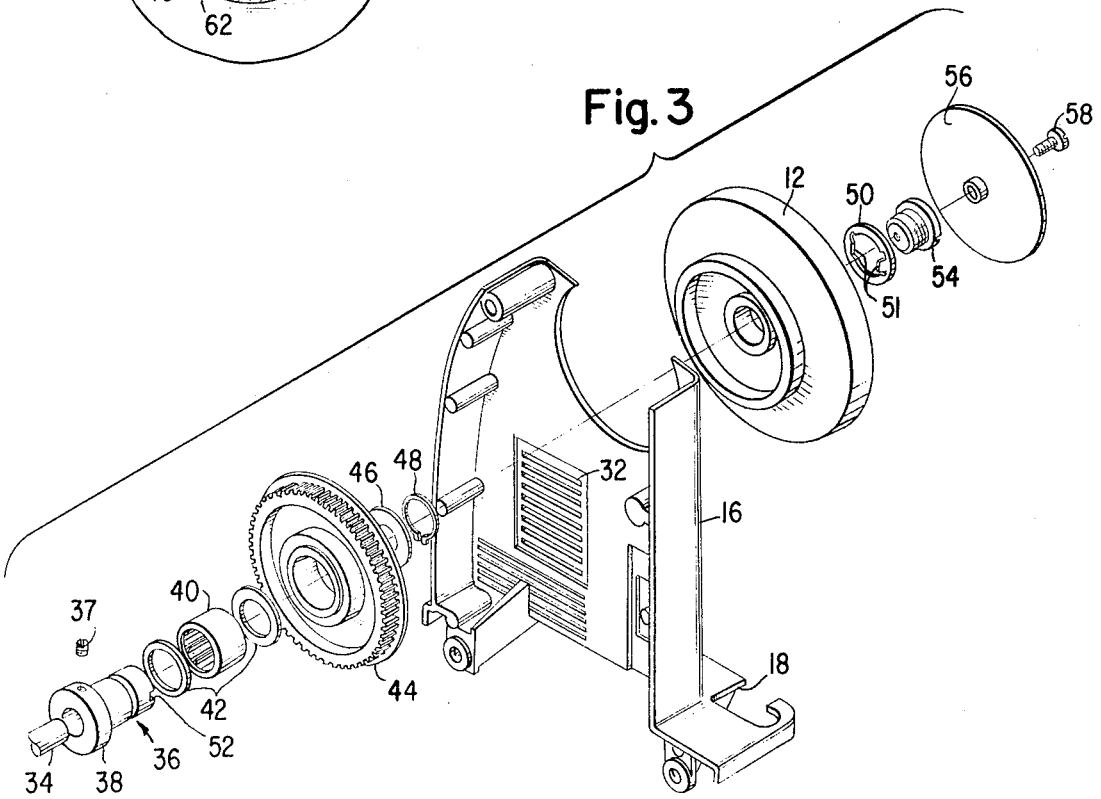

TREADLE DRIVE FOR ELECTRIFIED SEWING MACHINE

DESCRIPTION

BACKGROUND OF THE INVENTION

This invention is in the field of sewing machines; more particularly, the invention is concerned with a treadle drive for occasional use with a sewing machine which also is fitted with an electric motor.

The initial motor force for a sewing machine had to be supplied by an operator either by rotating a handwheel or, later, by the use of a foot treadle which freed the operator's hands for guiding a work material through the sewing machine. Early on, it was discovered that one of the problems with a foot treadle was that occasionally the sewing machine would begin rotating backwards which required an operator to rectify rotation, usually by corrective rotation of the handwheel. However, the most critical period in sewing machine operation is the initial operation which takes place before the position of the fabric plies has been fixed by stitches. Therefore, an operator required to take steps to correct sewing machine rotation must remove a hand from the task of fabric control in order to urge the handwheel in the correct rotation at the most critical time. In order to obviate this problem considerable inventive effort was devoted to schemes and devices which would prevent improper rotation of the sewing machine upon treadle actuation.

Subsequently, in some parts of the world, electric power became quite common and in these areas electric motors supplanted the use of foot treadles. However, in other areas of the world, electric power is only available during certain times and sewing machine operators must be provided with the option of utilizing the foot treadle or electrical motor. What is required is a sewing machine which may be operated by an electric motor or by a foot treadle and which will be deterred from reverse rotation while being actuated by the foot treadle.

SUMMARY OF THE INVENTION

The above desired end is obtained in a sewing machine having an internally supported electric motor connected by a timing belt to a pulley encircling the sewing machine horizontal arm shaft. The arm shaft pulley is supported on a one-way clutch, which one-way clutch is carried by a bushing affixed to the horizontal arm shaft of the sewing machine. Upon operation of the electric motor, the timing belt rotates the timing pulley and through the one-way clutch rotates the bushing and the horizontal arm shaft affixed thereto. A handwheel is attached to the bushing affixed to the horizontal arm shaft, the handwheel having a belt groove therein which may receive the belt of a treadle operated device when the electric motor is not to be used. When the treadle belt is located in the belt groove of the handwheel, and the treadle is actuated, the bushing is rotated and thereby the horizontal arm shaft. If the treadle urges the handwheel in the proper direction of rotation there will be little resistance to this rotation except for the usual friction of the rotating parts. If, however, the foot treadle tends to urge the handwheel into reverse rotation, the handwheel drives the bushing in this reverse rotation, locking the bushing to the timing pulley through the one-way clutch and creating a high inertia connection from the handwheel through the timing belt to the motor. If rotation can take place, the additional resistance is sensed immediately by an operator; however, the high inertia of the motor will usually only permit rotation of the arm shaft in the proper direction.

BRIEF DESCRIPTION OF THE DRAWING

The foregoing will be more readily apparent upon reading the following description in conjunction with the drawings in which:

FIG. 3 is an exploded isometric view of the handwheel end of the sewing machine shown in FIG. 2;

FIG. 4 is a sectional view of the handwheel end of the sewing machine shown in FIG. 2; and, FIG. 5 is a cross-sectional view taken substantially along the line 5—5 of FIG. 4.

Referring now to FIG. 1 there is shown a sewing machine 10 supported in a cabinet 20, the cabinet being provided with a treadle mechanism 24. A handwheel 12 of the sewing machine 10 is grooved to accept a belt 14 when the sewing machine is to be operated by the treadle mechanism 24, the belt being connected to a band wheel 26 of the treadle mechanism. For this invention the sewing machine 10 is of a variety having an internal electric motor so as selectively to be operated by the treadle mechanism or by the electric motor. Further specifics on the cabinet 20 and in particular on the treadle mechanism 24 may be had by reference to the U.S. Pat. No. 3,407,014 issued on Oct. 27, 1968 to Milan et al, assigned to the same assignee as the instant application and incorporated by reference herein.

Referring now to FIG. 2 the sewing machine 10 is shown in greater detail including the bed extension 16 having apertures 18, through which apertures the belt 14 extends between the handwheel 12 and the band wheel 26. Also shown is the on-off switch 30 for the electric motor (not shown) and cooling vents 32 therefor. In the event that the sewing machine 10 is to be operated by the electric motor, the belt 14 must first be removed from the handwheel 12, after which motorized operation may take place. Also, in this event, the treadle mechanism 24 would be folded away as disclosed in the above-referenced patent.

Referring now to FIG. 3 there is shown an exploded isometric view of the handwheel end portion of the sewing machine 10 to disclose the details of the selective drive arrangement. The sewing machine horizontal arm shaft 34 is shown in the extreme left and would normally extend into a bushing 36. The bushing has a set screw 37 extending through a collar 38 thereof so as to fix the position of the bushing with respect to the horizontal arm shaft 34. A one-way clutch 40 sits between two washers 42 on the bushing 36 adjacent the collar 38 thereof. A serrated timing pulley 44 is pressed fit on the one-way clutch 40 for torque transmission therethrough and the entire assembly is retained by a thrust washer 46 and retaining ring 48, which retaining ring fits into groove 39 of the bushing 36. The handwheel 12 is fastened to the bushing 36 by means of a washer 50 having internal ears 51 which extend into grooves 52 of the bushing 36. A plug 54 threads into the bushing 36 and retains the washer 50 against the bushing 36 and handwheel 12. A decal 56 covers the end of the handwheel 12 and is retained there by means of a screw 58 threadedly carried by the plug 54.

In FIG. 4 there is shown a cross-sectional view of the assembly of the component shown in exploded view in FIG. 3. Thus the bushing 36 is shown affixed to the horizontal arm shaft 34 by set screw 37 and the one-way clutch 40 is supported on the bushing with the timing pulley 44 supported on the clutch. The handwheel 12 is clamped to the bushing 36 by the plug 54 and washer 50. The handwheel 12 is fashioned with a belt groove 13 for receiving the treadle drive belt 14. The timing pulley 44 carries a timing belt which extends inwardly to the sewing machine to the motor (not shown) mounted internally of the sewing machine.

Referring now to FIG. 5 there is shown a sectional view through the timing pulley 44, one-way clutch 40, bushing 36 and arm shaft 34 to indicate the operation of the device. The forward direction of rotation for the arm shaft 34 is counterclockwise as indicated by the arrow in FIG. 5, the bushing 36 being affixed to the arm shaft by the set screw 37 rotates in the same direction. The one-way clutch 40 is supported on the bushing 36 on circumferentially spaced rollers 60, which rollers are retained in aperture 62 by spring clips (not shown). The timing pulley 44 is press fitted onto one-way clutch 40 and rotates therewith. It will be clear that if the timing pulley 44 is rotated in a counter-clockwise direction the rollers 60 will move to the narrow part of the aperture 62 and cause the bushing 36 and horizontal arm shaft 34 to move with the one-way clutch (see FIG. 5). If on the other hand the bushing 36 and the horizontal arm shaft are caused to rotate in a counterclockwise direction by the handwheel 12 under the urging of the treadle belt 14, the rollers 60 will move to the larger part of the aperture 62 and the bushing will rotate without drag or resistance from the one-way clutch 40 supported thereon. If, however, the handwheel 12 is caused to rotate in a clockwise direction by the treadle belt 14, the rollers 60 are forced into the narrow part of the aperture 62 thereby making a firm connection between the bushing 36 and the one-way clutch 40 and serrated timing pulley carried thereon and, through the timing belt 45, the electric motor (not shown) also. This resistance of rotation is immediately sensed by an operator who may then take corrective action by first halting and then reinitiating treadling. Where the motor is a high RPM motor and the ratio of the timing pulley 44 to the motor pulley is high, the reflected inertia of the motor will be appreciable and, effectively, will completely deter reverse rotation of the horizontal arm shaft 34 or cause slippage of the treadle belt 14 in the belt groove 13 of the handwheel 12.

Figure 1:
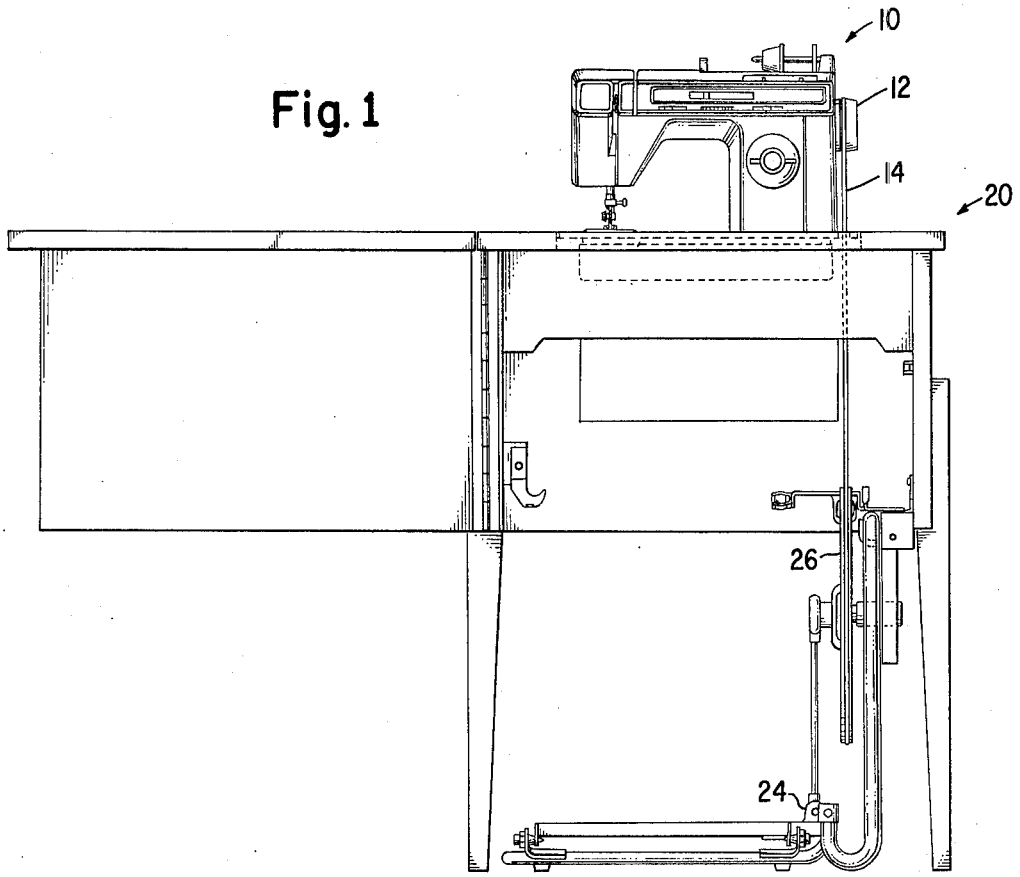
FIG. 1 is an elevation of a sewing machine supported in a cabinet having a treadle drive and connected thereto.
Figure 2:
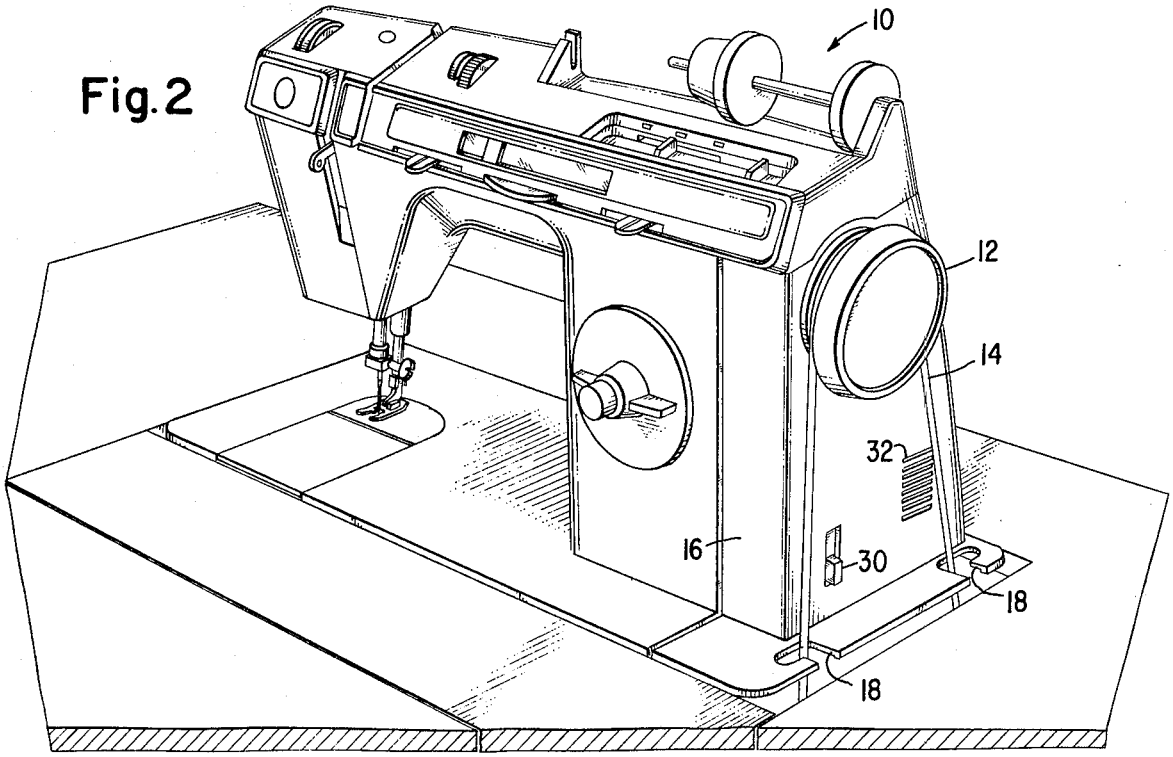
FIG. 2 is an isometric view of the sewing machine shown in FIG. 1, which sewing machine supports internally thereof an electric motor.

I claim:

1. A sewing machine comprising a frame, an arm shaft journalled in said frame for rotation in a specific direction, a handwheel operatively secured to an end of said arm shaft, a pulley operatively associated with said handwheel for actuation by an external driving means for driving said sewing machine through said pulley, a one-way clutch supported on said arm shaft, a first drive transmission component operatively connected to said one-way clutch, an internal driving means supported in said frame, additional drive transmission components interconnecting said internal driving means and said first drive transmission component, whereby said internal driving means may rotate said arm shaft of said sewing machine in said specific direction through said one-way clutch and said external driving means may drive said arm shaft in said specific direction with a minimum of resistance and in an opposite direction with additional resistance occasioned by driving said internal driving means through said first drive transmission component and said additional drive transmission components interconnecting said internal driving means and said first drive transmission component.

2. A sewing machine comprising a frame, an arm shaft journalled in said frame for rotation in a specific direction, a one-way clutch supported on said arm shaft, a first pulley supported on said one-way clutch, an electrical actuating means supported in said frame, a second pulley supported and driven by said actuating means, a belt interconnecting said first and said second pulley, said actuating means driving said arm shaft in said specific direction through said one-way clutch, a handwheel operatively secured to an end of said arm shaft, a third pulley operatively associated with said handwheel for actuation by an auxiliary driving means for driving said sewing machine through said third pulley, said auxiliary driving means driving said arm shaft in said specific direction with a minimum of resistance and in an opposite direction with additional resistance occasioned by driving said actuating means through said first and second pulley and said belt interconnecting said actuating means and one-way clutch.

3. A sewing machine as claimed in claim 2 wherein said first and second pulleys and said belt are releasably interengaged to preclude slippage of said belt on said pulleys.

* * * * *